US006718726B1

(12) United States Patent
Kuchel et al.

(10) Patent No.: US 6,718,726 B1
(45) Date of Patent: Apr. 13, 2004

(54) METHOD AND APPARATUS FOR STORING AND TRANSPORTING STRINGS OF POCKETED COILS

(75) Inventors: Bernhard W. Kuchel, Stone Mountain, GA (US); Michael W. Mauldin, Hiram, GA (US); Michael DiMarco, Atlanta, GA (US)

(73) Assignee: Dreamwell Ltd., Las Vegas, NV (US)

( * ) Notice: Subject to any disclaimer, the term of this patent is extended or adjusted under 35 U.S.C. 154(b) by 0 days.

(21) Appl. No.: 09/974,106

(22) Filed: Oct. 9, 2001

(51) Int. Cl.[7] ..... B65B 63/02; B65H 18/10

(52) U.S. Cl. ..... 53/118; 53/527; 242/471

(58) Field of Search ..... 53/430, 118, 114, 53/526, 527; 242/160.4, 169, 171, 360, 388.1, 471, 535.5, 548.1, 483.9; 247/471, 597.7

(56) References Cited

U.S. PATENT DOCUMENTS

| | | | | | |
|---|---|---|---|---|---|
| 1,401,123 | A | * | 12/1921 | Anderson | 242/575.2 |
| 1,535,372 | A | * | 4/1925 | Moran | 242/329 |
| 3,538,673 | A | * | 11/1970 | Mosetich et al. | 53/118 |
| 4,401,501 | A | | 8/1983 | Stumpf | |
| 4,406,391 | A | | 9/1983 | St. Clair | |
| 4,439,977 | A | | 4/1984 | Stumpf | |
| 4,458,467 | A | * | 7/1984 | Shulman et al. | 53/399 |
| 4,480,800 | A | * | 11/1984 | Oberg et al. | 242/535 |
| 4,489,901 | A | * | 12/1984 | Andersen | 242/471 |
| 4,491,491 | A | | 1/1985 | Stumpf | |
| 4,565,046 | A | | 1/1986 | Stumpf | |
| 4,566,924 | A | | 1/1986 | Hara et al. | |
| 4,566,926 | A | | 1/1986 | Stumpf | |
| 4,578,834 | A | | 4/1986 | Stumpf | |
| 4,600,161 | A | * | 7/1986 | Barboza | 242/471 |
| 5,007,597 | A | * | 4/1991 | Jones | 242/420.6 |
| 5,100,074 | A | * | 3/1992 | Jones | 242/420.6 |
| 5,126,004 | A | | 6/1992 | Suenens et al. | |
| 5,186,435 | A | | 2/1993 | Smith | |
| 5,509,887 | A | | 4/1996 | Smith | |
| 5,572,853 | A | | 11/1996 | St. Clair et al. | |
| 5,613,287 | A | | 3/1997 | St. Clair | |
| 5,621,935 | A | | 4/1997 | St. Clair | |
| 5,637,178 | A | | 6/1997 | Suenens et al. | |
| 5,746,877 | A | | 5/1998 | Notheis et al. | |
| 5,749,133 | A | | 5/1998 | Mauldin et al. | |
| 6,021,627 | A | | 2/2000 | Mossbeck et al. | |
| 6,101,697 | A | * | 8/2000 | Stumpf et al. | 29/91 |
| 6,119,971 | A | * | 9/2000 | Jones | 242/420.6 |

FOREIGN PATENT DOCUMENTS

| | | |
|---|---|---|
| EP | 624 545 | 9/1997 |
| WO | WO 97/37569 | 10/1997 |

* cited by examiner

*Primary Examiner*—Rinaldi I. Rada
*Assistant Examiner*—Paul Durand
(74) *Attorney, Agent, or Firm*—Ropes & Gray, LLP

(57) ABSTRACT

An apparatus and method for winding strings of pocketed coils onto a spool. The coil spooling apparatus includes a feed mechanism and a spooler. The feed mechanism includes buffer rollers and an adjustable hollow feed arm. The feed arm terminates adjacent to the spooler. The spooler includes a spool with a horizontally or vertically oriented spool core, a drive mechanism, and a turntable base with a pallet. The drive mechanism powers the rotation of the spool core. The rotation of the spooler winds the string of pocketed coils received from the feed mechanism. The feed mechanism buffers the tension and directs the string of pocketed coils along the horizontal and vertical axis. After the desired size of wound package is reached, the rotation of the spooler ceases. The completed wound package can then be lifted while attached to the spool through the use of a fork lift. The vertical spools can be stored and transported in a vertical position since the core base is flat. The spools can be unwound and the springs uncompressed when needed to manufacture mattress constructions.

7 Claims, 3 Drawing Sheets

METHOD AND APPARATUS FOR STORING AND TRANSPORTING STRINGS OF POCKETED COILS

BACKGROUND OF THE INVENTION

1. Field of the Invention

The invention relates generally to a material handling system, particularly for handling pocketed coil strings.

2. Brief Description of the Prior Art

Pocketed coil strings have been used for many years in the manufacture of upholstered furniture and mattresses. A pocketed coil machine is used to make pocketed coil strings by inserting springs into pockets as shown in U.S. Pat. No. 5,749,133 and U.S. Pat. Nos. 5,613,287, 5,186,435, 4,565,046, and 4,439,977, assigned to the applicant of the current application. After the pockets are sealed, the springs are expanded within the pockets. Multiple pockets make up a string of pocketed coils.

These pocketed coil strings are typically stored and transported in large bins. The pocketed coil strings are loosely piled into the bin until the bin is full. U.S. Pat. No. 4,406,391 discloses an accumulator bin for handling strips of pocketed coil springs. The bins have casters mounted on the underside to facilitate movement. These bins are then moved around the manufacturing facility by hand. The bins filled with pocketed coil strings are manually transported to other areas of the facility for further use during the mattress or upholstered furniture manufacturing process.

In connection with the mattress manufacturing process, the strings are cut into smaller sections by another machine and attached together via gluing or some other manner known in the art to form an intermediate product known as a construction. These constructions are then used to manufacture a final product such as a mattress.

Alternatively, constructions could be shipped as subassemblies for final assembly into mattresses and furniture. For shipment, the constructions typically are compressed and strapped. Employee safety, however, is a concern when the straps on the compressed constructions are cut during the unwrapping process, and all of the springs in the constructions expand simultaneously.

Furthermore, logistical problems exist because a wide variety of constructions have to be shipped to mattress manufacturing facilities. Mattresses constructions are typically made in the following sizes: California King, King, Olympic Queen, Queen, Full XL, Full, Twin XL, and Twin. Each mattress size requires a different length of pocketed coil string. The various constructions are also available with different coils and different wire gauges. Thus, a mattress manufacturing facility must maintain a large and varied inventory of constructions for use in the final assembly of mattresses.

SUMMARY OF THE INVENTION

It is therefore an objective of this invention to provide an improved method of transporting and storing pocketed coil strings. This method would allow safe storage and transportation of pocketed coil strings while also being economical.

It is a further objective of this invention to provide an apparatus and system to facilitate this improved method of transporting and storing pocketed coil strings.

These and other objectives of the invention are accomplished by a system and method of storing and transporting pocketed coil strings in which the pocketed coil string is wound onto a spool with the springs in a compressed state. Instead of causing the expansion of the springs in the pockets of the pocketed coil strings after they are manufactured by a pocketed coil machine, the inventive method leaves the springs compressed within the fabric pockets of the pocketed coil string. With the springs compressed within the fabric pockets, a string spooling apparatus is then used to wrap the pocketed coil strings with compressed springs around a spool. The spool may be arranged to wrap the pocketed coil strings about either a vertical or a horizontal axis.

The wound packages of pocketed coil strings with compressed springs are then transported to another manufacturing facility, preferably with the axis of the spools oriented in the vertical direction so the wound packages do not roll around during transport. In order to utilize the pocketed coil strings, the pocketed coil strings are unwound from the spools. During the unwinding process, the compressed springs are allowed to expand in the pocketed coil string, one at a time, as the pocketed coil string is unwound. The pocketed coil string with expanded springs is then cut to the desired length for manufacturing the desired construction.

By wrapping the pocketed coil strings with compressed springs around a spool, substantially less space is used than by storing pocketed coil strings with expanded springs in bins. Furthermore, the present invention allows for greater flexibility in manufacturing because the constructions do not have to be made before shipping to a remote facility for final assembly. This reduces the need to manufacture a large variety of constructions for different end uses.

Moreover, transporting and handling of the wound package of pocketed coil strings is safer than transporting wrapped and banded constructions. When the ties on a wrapped and banded constructions are cut, the compressed springs in the constructions expand rapidly and simultaneously thereby causing a dangerous situation for employees. By contrast, when the wound package of the pocketed coil string is unwound, the spring tension within the pocketed coil string is relieved essentially one spring at a time as the pocketed coil string is unwrapped from the spool. Therefore, the danger of rapid expansion of a number of springs simultaneously is eliminated.

Further objects, features, and advantages will become apparent upon consideration of the following detailed description of the invention when taken in conjunction with the drawings and the appended claims.

BRIEF DESCRIPTION OF THE DRAWINGS

The objectives and features of the invention will become more readily apparent from the following detailed descriptions taken in conjunction with the accompanying drawings in which.

DETAILED DESCRIPTION OF THE INVENTION

Figure 1:
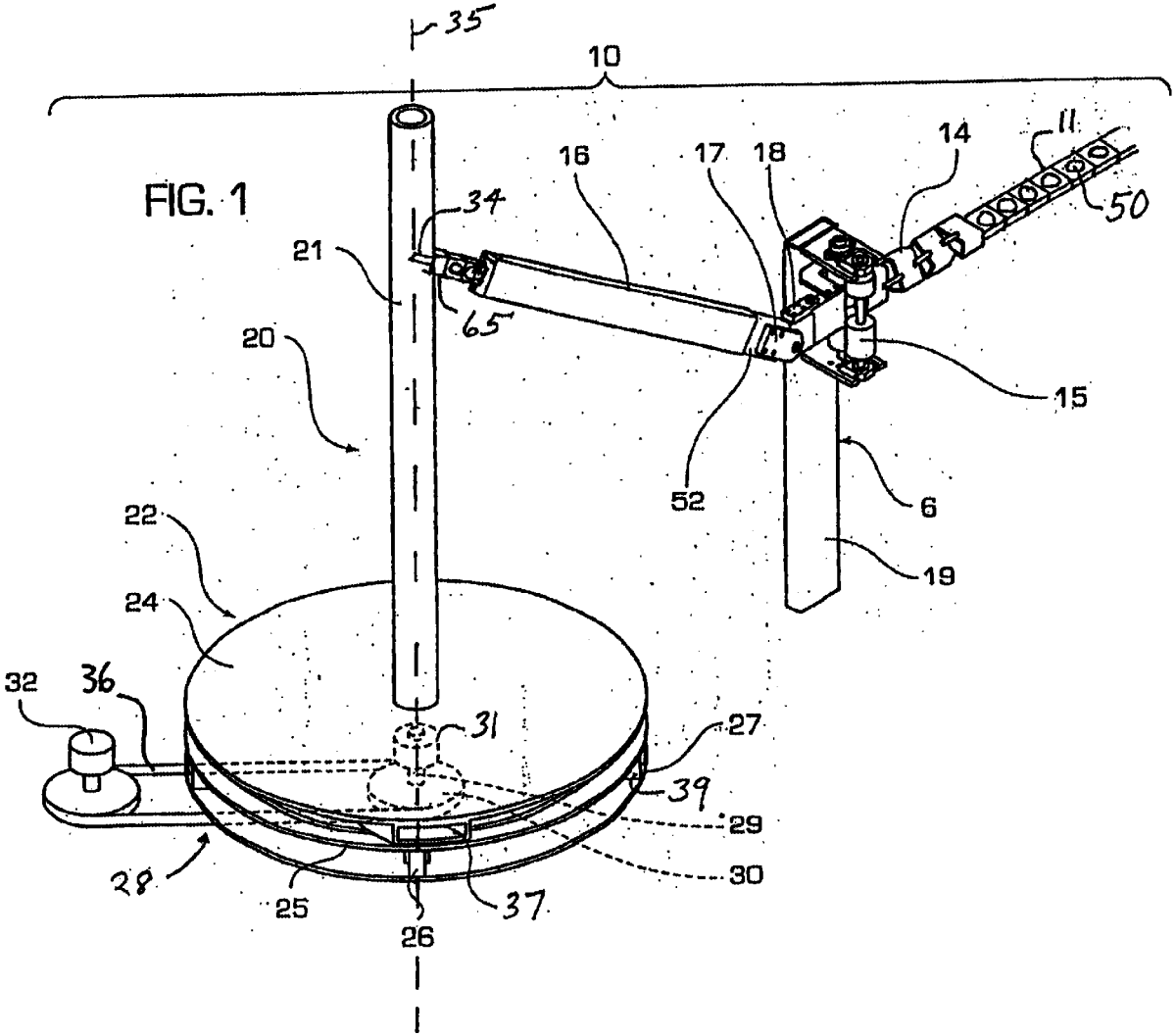
FIG. 1 is a perspective view of a pocketed coil string spooling apparatus in accordance with the present invention.

As shown in FIG. 1, a coil spooling apparatus 10 creates a wound package for storing and transporting a continuous pocketed coil string 11. The spooling apparatus 10 comprises a spooler 20 and a feed mechanism 6.

The feed mechanism 6 receives the pocketed coil string 11 from a pocketed coil machine 110 (FIGS. 3 and 4) and feeds the pocketed coil string 11 to the spooler 20. The feed mechanism 6 comprises a string orienting guide 14 and a pair of buffer rollers 15 attached to a support 19. A hollow feed arm 16 is also attached to the support 19 on the side of the feed mechanism 6 adjacent to the spooler 20. Particularly, the hollow feed arm 16 is attached to the support 19 by means of a first hinge 17 supporting vertical pivoting of the feed arm 16, and a second hinge 18 supporting horizontal pivoting of the feed arm 16. A movement regulator 52 controls the vertical and horizontal movement of the feed arm 16. The movement regulator 52 can be a jack screw apparatus, linear actuator, piston, or other means known in the art to control the movement of the feed arm 16 about hinges 17 and 18. The feed arm 16 terminates adjacent to the spooler 20. The spooler 20 and the support 19 are mounted to a support structure (not shown) in order to maintain a constant spacing between the spooler 20 and the support 19 of feed mechanism 6.

The spooler 20 comprises a spool 22 onto which the pocketed coil string 11 is wrapped and a drive mechanism 28 for rotating the spool 22 during the pocketed coil string wrapping process. The spool 22 comprises a core 21 and core base 24. In the embodiment shown in FIG. 1, the axis 35 of the spool core 21 is vertically oriented. The core base 24 further has opening 37 to accommodate the fork of a forklift truck.

In order to rotate the spool 22, the drive mechanism 28 comprises a stationary base 27 with a turntable 25 mounted thereon for rotation about axis 35. The turntable 25 has casters 26 located on its underside, and the casters 26 ride on the stationary base 27 during rotation of the turntable 25. The turntable 25 also has opening 39 to accommodate the fork of a forklift truck. A drive shaft 29 is journaled for rotation into the stationary base 27. A sprocket 30 is attached to the drive shaft 29. The sprocket 30 is driven by means of a drive belt 36 connected to a motor 32 so that the motor 32 causes the turntable 25 to rotate with respect to the stationary base 27.

In order to wind a package of pocketed coil string 11, the spool 22 is positioned on the turntable 25 so that the core base 24 of the spool 22 engages the drive shaft 29 by means of a coupler 31. When the motor 32 rotates the drive shaft 29, the spool 22, riding on top of the turntable 25 and driven by means of the coupling 31 rotates about axis 35. Once the package of pocketed coil string 11 has been wound, the wound package may be moved by means of a forklift truck engaging the opening 37 in the core base 24 of the spool 22. Alternatively, the package may be moved by disengaging the coupling 31, lifting the turntable 25 and spool 22 from the stationary base 27 by means of the forklift opening 39, and subsequently moving the turntable 25 about a work area on its casters 26.

Figure 2:
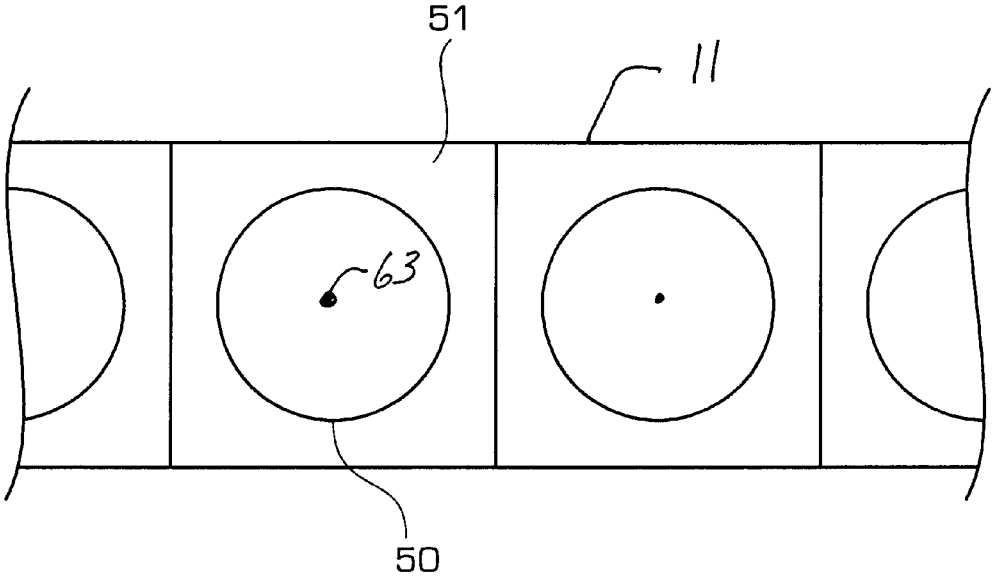
FIG. 2 is a top plan view of a pocketed coil string with compressed springs in accordance with present invention.

FIG. 2 shows in greater detail the pocketed coil string 11 with a compressed spring 50. The pocketed coil string 11 includes a sealed duon pocket 51 containing a compressed spring 50.

The following is an explanation of the use of the coil spooling apparatus 10 shown in FIG. 1. A pocketed coil machine (not shown) manufactures a pocketed coil string 11 such that the springs 50 are not expanded (as shown in FIG. 2). After the pocketed coil string 11 exits the pocketed coil machine, the pocketed coil string 11 is fed through the feed mechanism 6 that is located between the pocketed coil machine and the spooler 20. The feed mechanism 6 receives the pocketed coil string 11 from the pocketed coil machine and reorients the pocketed coil string 11 about its longitudinal axis by means of string orienting guide 14 so that the pockets 51 with compressed springs 50 are reoriented from horizontal to vertical. Thus oriented, the axes 63 of the compressed springs 50 are oriented perpendicularly to the vertical axis 35 of the spool core 21. The pocketed coil string 11 then travels through a pair of buffer rollers 15 to convert the discontinuous advancement of the pocketed coil machine to a continuous feed for spooling the pocketed coil string 11. The pocketed coil string 11 exits the buffer rollers 15 into the hollow feed arm 16.

The pocketed coil string 11 exits the feed arm 16, and the first end 65 of the pocketed coil string 11 is attached to the spool core 21 by a tape 34 or by other suitable means. Once the coil string 11 has been attached to the spool core 21, the spool core 21 is rotated by a motor 32 as previously explained. The rotation of the spool core 21 winds the pocketed coil string 11 onto the spool core 21 to create a wound package of the pocketed coil string 11. The spooling is facilitated by the feed arm 16, which pivots about hinge 17 and thereby continuously sweeps back and forth along length of the spool core 21. The feed arm 16 also pivots about hinge 18 and thereby moves outwardly away from the spool core 21 as the package grows. This movement of the feed arm 16 is controlled by the regulator 52. In addition, the speed of the motor 32 is coordinated with the regulator 52 and the speed of the buffer rollers 15 to accommodate the increasing diameter of the package as the pocketed coil string 11 is wound onto the spool core 21.

After the pocketed coil string 11 has been wound around the spool core 21 to the desired size, the pocketed coil string 11 is cut, and the loose end is secured to the wound package so that the pocketed coil string 11 will not unwind under the influence of the compressed springs in the pocketed coil string.

Once the wound package of the pocketed coil string is secured, a forklift engages the opening 37 in order to lift the vertically standing package of the pocketed coil string 11. The forklift is then able to transport the vertically standing wound packages to a tractor-trailer or other means for transportation. Alternatively, the forklift can lift the package and the turntable 25 by means of opening 39 off of the stationary base 27. Once the package and turntable 25 have been lifted from the stationary base 27, the package and turntable 25 may be lowered onto the casters 26 for movement about the work area on the casters 26.

Figure 3:
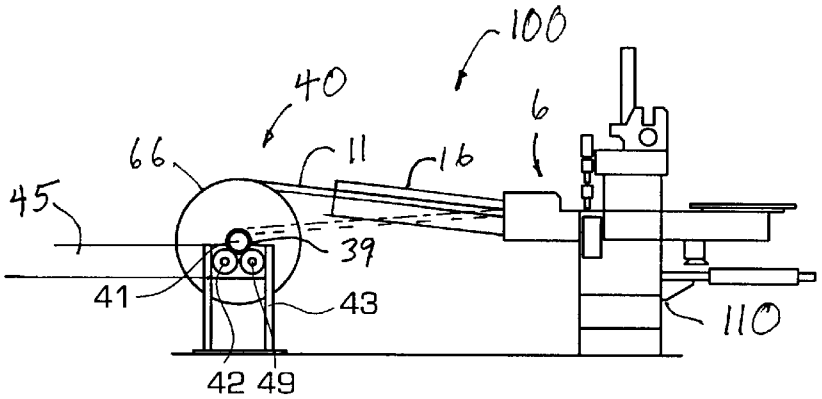
FIG. 3 is side view of an alternative embodiment of the coil spooling apparatus in accordance with the present invention.
Figure 4:
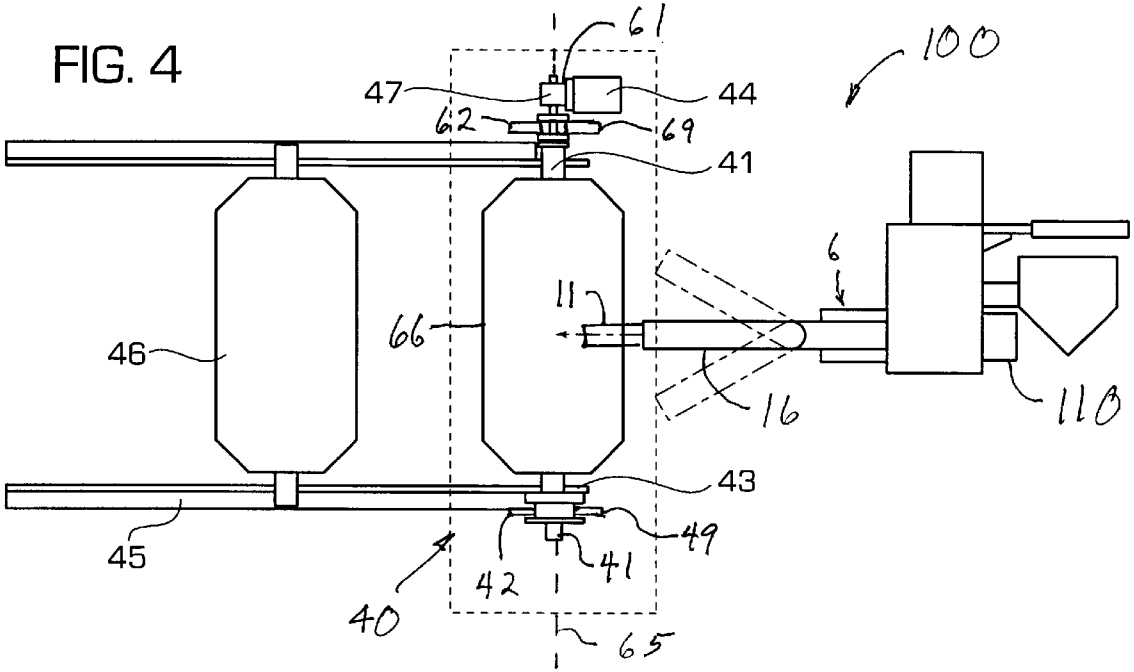
FIG. 4 is a top elevation view of the alternative embodiment of the coil spooling apparatus with guide rails in accordance with the present invention.

FIGS. 3 and 4 depict an alternative embodiment of pocketed coil string spooling apparatus 100 of the present invention comprising a horizontal spooler 40 and the feed mechanism 6. The coil spooling apparatus 100 is used to create packages 46 and 66 of the pocketed coil string 11. The feed mechanism 6 is the same as that shown in FIG. 1. The spooler 40 comprises a horizontal spool 39 with a spool drive mechanism 61. The spool 39 comprises spool core 41 which is mounted for rotation about axis 65 on idler wheels 42, 62, 49, and 69 attached to a frame 43 (FIG. 4).

As best seen in FIG. 4, the spool core 41 is rotated by the drive mechanism 61. The drive mechanism 61 comprises a motor 44 connected to one end of the spool core 41 by means of an air chuck 47. Other means known in the art for rotating the spool core 41 could be used. The frame 43 of the spooler 40 may be extended with a pair of guide rails 45. A completed wound package 46 of the pocketed coil string 11 can then be rolled along the guide rails 45 for storage in a remote location.

As previously described with respect to the vertical package created in connection with the spooling apparatus 10 shown in FIG. 1, the coil spooling apparatus 100 operates to create packages 46 and 66. In order to wind the package 66, the speed of the drive motor 44, the orientation of the hollow feed arm 16, and the speed of the buffer rollers 15 are all coordinated to provide an even wind of the pocketed coil string 11 onto the package 66. Once the package 66 is completed, the package 66 may be moved along rails 45 to a remote location where it can be handled by a forklift. In connection with handling the package 66, the forklift or other lift mechanism should engage the ends of spool 41 so that the pocketed coil string 11 on the outside of the package 46 is not damaged.

With respect to transportation and storage of the completed packages of the pocketed coil string, the vertical orientation of the spools of packages during transport is more advantageous than horizontally oriented spools. Vertically oriented spools are able to remain in the vertical position due to the core mounting having a flat core base 24. This allows the trailer to be packed with spools that will not roll around or exert excess pressure upon the sidewalls of the trailer. If horizontally oriented spools are stored with the axis 65 parallel to the back of the truck, there is the danger of a spool rolling out when the trailer door is opened. Furthermore, placing horizontal spools such that the axis 65 is perpendicular to the door of the truck creates pressure on the sidewalls of the truck during transport, as the rolls tend to push against the sides.

The packages of wound pocketed coil strings are transported by truck or other means to a manufacturing facility, and the packages may be unloaded through the use of a forklift truck. The packages can also be stored for future use thereby taking up less space then a bin of pocketed coil strings or piles of constructions. When needed, the manufacturer unwinds the package of the pocketed coil string 11 and cuts off a desired length of the pocketed coil string 11. The springs 50 in the pocketed coil string 11 are then expanded and glued together to form a construction.

The disclosed method allows increased efficiency for the manufacturer and greater flexibility in the end use of the pocketed coil strings. The method of the present invention also circumvents the need to make and maintain an inventory of a variety of constructions. The wound package of the pocketed coil string could be used to make any size of construction. Furthermore, the transportation and unwinding of the package of the pocketed coil string is much safer than the unwrapping of the wrapped and compressed constructions. Typically, a large amount of space is needed to unwrap compressed constructions due to the forces released. This is not the case with the wound packages.

We claim:

1. An apparatus for spooling a string of pocketed compressed coil springs, comprising:

a. a spooler comprising:
   i. a spool core rotatable about a core axis; and
   ii. a drive mechanism to rotate the core about the core axis for winding the string of pocketed compressed coil springs about the spool core; and b. a feed mechanism comprising:
   i. buffer rollers engaging the string of pocketed compressed coil springs to maintain the springs in a compressed state and reduce advancement jitter of the string; and
   ii. a feed arm to receive the string of pocketed compressed coil springs from the buffer rollers, maintain the springs in a compressed state, and distribute the string of pocketed compressed coil springs about the spool core, wherein the drive mechanism of the spooler is coordinated with a feed speed of the buffer rollers to ensure that the string of pocketed compressed coil springs winds evenly about the core and the springs are maintained in a compressed state.

2. The apparatus of claim 1, wherein the core axis is substantially vertical.

3. The apparatus of claim 1, wherein the core axis is substantially horizontal.

4. The apparatus of claim 1, wherein the feed arm maintains the springs in a compressed state and moves in a direction substantially parallel to the core axis and a direction substantially perpendicular to the core axis, to distribute the string of pocketed compressed coil springs evenly about the spool core.

5. The apparatus of claim 1, wherein the spooler further comprises a turntable base comprising a pallet mounted thereon for supporting the spool core and rotating with the core.

6. The apparatus of claim 1, wherein the feed arm comprises a hollow elongate cavity.

7. The apparatus of claim 1, wherein the feed mechanism further comprises an orienting guide for aligning the string of pocketed compressed coil springs at a predetermined orientation, maintaining the springs in a compressed state, and feeding the string to the buffer rollers.

* * * * *